United States Patent [19]

Reinhardt et al.

[11] 4,376,633

[45] Mar. 15, 1983

[54] ZWITTERION COMPOUNDS AS CATALYSTS IN EASY-CARE FINISHING

[75] Inventors: Robert M. Reinhardt; Donald J. Daigle, both of New Orleans, La.

[73] Assignee: The United States of America as represented by the Secretary of Agriculture, Washington, D.C.

[21] Appl. No.: 272,842

[22] Filed: Jun. 12, 1981

[51] Int. Cl.[3] ..... D06M 15/54; D06M 15/58; D06M 15/56

[52] U.S. Cl. ..... 8/184; 8/185; 8/186; 8/187; 8/116.4

[58] Field of Search ..... 8/185, 186, 187, 184, 8/116.4

[56] References Cited

U.S. PATENT DOCUMENTS

| | | | |
|---|---|---|---|
| 3,778,226 | 12/1973 | Kissa | 8/185 |
| 3,948,600 | 4/1976 | Reinhardt et al. | 8/187 |
| 3,960,483 | 6/1976 | Payet | 8/116.4 |

OTHER PUBLICATIONS

B. A. Kottes Andrews, R. J. Harper, Jr., SRRC Reprint No. 6621.

Sidney L. Vail, "Variables That Influence Formaldehyde Release From Cottons Finished For Durable Press" Textile Research Journal, vol. 50, No. 5, (May 1980) pp. 315–322.

*Primary Examiner*—Maria Parrish Tungol

*Attorney, Agent, or Firm*—M. Howard Silverstein; David G. McConnell; Raymond C. Von Bodungen

[57] ABSTRACT

Zwitterions are employed as catalysts in a chemical finishing process to treat cellulosic textiles with crosslinking agents and produce easy-care properties in the finished materials. The process comprises treatment of the textile material, such as cotton fabric, by impregnating it with a solution containing a cellulose-crosslinking agent and, as catalyst a zwitterion, alone or in combination with a magnesium salt, drying and curing the fabric. Said finished fabrics are characterized by an unusual combination of useful, desirable properties—smooth-drying appearance, wrinkle resistance, serviceable strength, and inoffensive formaldehyde release.

9 Claims, No Drawings

ZWITTERION COMPOUNDS AS CATALYSTS IN EASY-CARE FINISHING

BACKGROUND OF THE INVENTION (1) Field of the Invention

This invention relates to chemical finishing processes for textiles. More particularly it relates to catalysts for treatment of cellulose-containing textile materials with crosslinking agents to produce easy-care properties.

(2) Description of the Prior Art

It is well known that smooth drying appearance and wrinkle resistance of cellulose-containing textiles can be enhanced by suitable treatment of such materials with certain chemical agents. The chemical agents employed in such treatments generally require catalysts to affect reaction with the cellulosic components to achieve improvement of the desirable properties in the finished products. Consideration of strength losses and formaldehyde release have limited the scope of catalysts acceptable in finishing operations. Those catalysts widely employed in the processing of textiles for durable-press, for instance, are not normally useful in other processes.

Sulfur acids such as hydroxymethanesulfonic, methanesulfonic, and para-toluenesulfonic have been cited for their use as catalysts in durable press finishing. These are strong acids capable of promoting crosslinking in cotton with a high degree of efficiency. However, because they are strong acids, careful control in finishing must be maintained so as to avoid severe damage to the physical properties of the treated fabrics. Even with this careful control and use of these acids, treated fabrics have tearing and breaking strength retention values much lower than desired. It is also known from work by Andrews, Harper, and Vail (Textile Research Journal, Vol. 50, pages 315–322, May 1980) that Bronsted acids, such as the sulfonic acids mentioned above, catalyze the crosslinking reaction and, if not completely washed out after finishing, catalyze the reverse reaction (hydrolysis of crosslinks) to release odiferous formaldehyde. Also taught by Andrews, Harper, and Vail (op. cit.) is the knowledge that Lewis acids also are capable of catalyzing the crosslinking reaction but are not as hydrolytically active as the Bronsted acids. Mixtures of these two types of catalysts are known to those skilled in the art as mixed catalysts. One of the more widely used of these mixed catalysts is the mixture of magnesium chloride and citric acid. A synergistic effect from this combination is such that higher durable-press ratings result than can be produced from either component by itself from a given set of finishing conditions. However, this synergistic effect of catalyzing the crosslinking reaction also applies itself to the hydrolysis or reverse reaction in which decrosslinking or promotion of formaldehyde release occurs.

An ideal catalyst would be one which is acidic enough to promote the crosslinking reaction but is not so acidic as to severely weaken the fabric during finishing. Also, this same catalyst must not after finishing be capable of reversing these crosslinks and promote formaldehyde release. Thus, the theory that any acid will do in catalysis of durable press finishing must be flawed. Researchers in catalysis have tried to show why certain catalysts are better than others, and if not better overall, than at least better for a specific application.

Salts of strong acids, and in particular, ammonium salts, such as ammonium chloride have been used as catalysts because they are the combination of a strong acid and a weak base. Hydrolysis of such salts produces an acidic solution.

There are also organic compounds which contain both acid and basic moieties. Dependent upon the strength of these acidic and basic moieties, these compounds are capable of attracting or releasing protons. Such compounds are known as zwitterions. In much the same manner as the inorganic ammonium salts hydrolyze to produce an acidic solution, the solubilization of zwitterions which contain an amine group and a strongly acidic group such as sulfonic, sulfinic, phosphinic, phosphonic, and multiples thereof also produce an acidic solution. Acidic amino acids, that is compounds which contain fewer amino groups than carboxyl groups are also included in this class of compounds, zwitterions.

SUMMARY OF THE INVENTION

This invention provides an improved process for the finishing of cellulosic fabrics to produce easy-care textiles characterized by an unusual combination of smooth-drying appearance, wrinkle resistance, serviceable strength, and inoffensive formaldehyde release properties. Said process comprises treatment of the fabrics by impregnating with a solution containing a cellulose-crosslinking agent and as catalyst a zwitterion, alone or in combination with a magnesium salt, drying the fabric, and curing the fabric.

It is thus an object of this invention to produce cellulose-containing fabrics with excellent durable-press appearance, serviceable strength, and inoffensive formaldehyde release.

It is a further object to provide improved catalyst systems that are efficient and practical for use in treatments of cellulose-containing textiles with suitable agents.

A still further object is to furnish catalyst systems that will provide effective and efficient catalysis on flash curing as well as in conventional pad-dry-cure finishing.

The objects of this invention are achieved by use of the catalyst systems based on appropriate zwitterions or appropriate zwitterions and magnesium chloride in treatments for cellulose-containing textiles with aldehyde or formaldehyde-amide finishing agents. The specific combination of aminomethanesulfonic acid or 2-aminoethanesulfonic acid and magnesium chloride provides efficient, rapid catalysis and produces a fabric with excellent smooth drying appearance, serviceable strength and low formaldehyde release.

Because of their zwitterion structures, aminomethanesulfonic acid and 2-aminoethanesulfonic acid, differ dramatically in their performance as catalysts when compared to aromatic alkane, and substituted alkanesulfonic acids. The latter are so strongly acidic that they must be used under milder curing conditions and/or in much more dilute concentrations lest the strength of the finished fabrics be severly diminished.

DESCRIPTION OF THE PREFERRED EMBODIMENTS

We have found catalyst systems consisting of zwitterions such as aminomethanesulfonic or aminoethanesulfonic acid and magnesium chloride to be highly efficient in treatments for producing durable-press fabric with serviceable strength and low formaldehyde release. This is particularly noteworthy as anyone skilled in the art would avoid use of a sulfonic acid on the fabric at elevated temperatures because of the well known deleterious effect of the hydrolytic action of strong acids on textile properties. Also, particularly noteworthy is the use of a mixture of aminomethanesulfonic acid and magnesium chloride as a mixed catalyst to produce a durable-press fabric with low formaldehyde release. The catalyst systems consisting of aminomethanesulfonic acid or aminomethanesulfonic acid and magnesium chloride are effective at conventional curing temperatures up to about 200° C. A rapid, high temperature cure, hereinafter referred to as flash curing can be accomplished at 200° C. in 20 seconds.

The textile material treated according to the teachings of this invention may be in the form of fibers, yarns, or fabrics. The preferred form is fabric which may be woven, knitted, or nonwoven. The textile may be composed entirely of cellulosic fibers, either natural or regenerated, or may be composed of said cellulosics as components of the textile structure with other cellulosic, noncellulosic natural, or synthetic fibers. Textiles composed of cotton and of cotton and polyester fibers are well suited to use in the processes of this invention.

The chemical agents that may be employed as finishing agents in treatment of textiles with the zwitterion catalysts of this invention include aldehydes such as formaldehyde, glyoxal, glutaraldehyde, and the like, and methylolamide compounds such as dimethylol derivatives of ureas, ethyleneurea, dihydroxyethyleneurea, urons, triazones, pyrimidones, melamines, carbamates, and the like. Among specific agents that have been found to be particularly useful in the process of this invention are formaldehyde, glyoxal, dimethylol dihydroxyethyleneurea (DMDHEU), dimethylol ethyleneurea (DMEU), and dimethylol methoxyethyl carbamate (DMMEC). Alkoxylated methylolamides also should be applicable as finishing agents with the zwitterion catalysts. The amount of finishing agent used in the treatment may vary from about 2% to about 15%, by weight of the treatment bath. About 8% to 10% is the most usual concentration employed.

Additives, softeners, modifiers, and other components customarily used in textile finishing pad baths can be used with the catalyst systems of this invention. The composition of the treatment bath is limited only by the compability of the ingredients with the catalyst.

The catalyst systems of this invention are composed of suitable zwitterions alone or in combination with a magnesium salt. Among the suitable zwitterions are taurine, aminomethanesulfonic acid, aminomethanephosphonic acid, aminoethanephosphonic acid, aminomethanephosphinic acid, aminomethanesulfinic acid, aspartic acid, and glutamic acid and the like.

A particularly attractive zwitterion for use by the teachings of this invention is aminomethanesulfonic acid. This potentially inexpensive compound is readily prepared as a stable crystalline compound, m.p. 185°–186° C., from formaldehyde, sodium bisulfite, and ammonium hydroxide, followed by acidification. The reaction scheme is depicted in the following equations.

$$CH_2O + NaHSO_3 \rightarrow HOCH_2SO_3Na$$

$$HOCH_2SO_3Na + NH_4OH \rightarrow H_2NCH_2SO_3Na$$

$$H_2NCH_2SO_3Na + H^+ \rightarrow H_2NCH_2SO_3H$$

It is sufficiently water soluble for use as a catalyst in textile treatment baths. It is less acidic than hydroxymethanesulfonic acid; acidity of aqueous solutions of aminomethane-sulfonic acid ranged from pH 3.81 for a 0.3% solution to pH 3.45 for a 5% solution (by weight).

Concentrations of zwitterion that may be used are from about 0.2% to about 1.5% by weight of the finishing bath. These concentrations of zwitterion may be used alone or in combination with suitable Lewis acids such as magnesium chloride, magnesium bromide, magnesium sulfate, magnesium nitrate, and the like. Concentration of magnesium chloride (as the hexahydrate) of from about 0.5% to about 2.0% may be employed with zwitterion. The ratios, by weight, of zwitterion to magnesium chloride hexahydrate, may be in the range from about 1.2:1 to about 1:7.5. From economic considerations, the total catalyst concentration of zwitterion plus magnesium chloride hexahydrate did not exceed 2.4% by weight of the finishing bath. Preferred catalyst compositions are demonstrated in the examples below.

Finishing treatments in which the zwitterion catalyst systems of this invention can be employed include conventional methods such as pad-dry-cure finishing, flash-cure finishing, post-cure finishing and the like as well as specialized finishing treatments such as one-step dry-cure finishing, super-heated steam cure finishing and the like.

Treatments were carried out by impregnating fabric by immersing it in the treatment solution (finishing pad bath), squeezing free of excess solution by passing through pad rolls, drying at a moderately elevated temperature (usually so that the temperature of the fabric does not exceed about 100° C.) and curing at a higher temperature. Curing temperatures from about 120° to about 160° C. are satisfactory at times ranging from about 1 minute to about 3 minutes, the longer times being preferred for the lower temperatures. Temperatures to achieve flash curing range from about 175° C. to about 215° C. with the preferred temperature being about 200° C. Times for flash curing may be from about 10 seconds to about 45 seconds. The preferred flash curing conditions are 20 seconds at 200° C. While the fabric can be utilized after finishing, it is good finishing practice to afterwash the fabric to remove residual chemicals and by-products.

The following examples further describe the invention and are given as illustrations but should not be considered as limiting the scope of the invention.

Properties of the fabrics were determined by known test methods: durable-press (DP) ratings after machine washing and tumble drying by AATCC Test Method 124-1969; wrinkle recovery angles by AATCC Test Method 66-1968; formaldehyde release by AATCC Test Method 112-1978 (sealed jar method); breaking strength by ASTM D1682-64; tearing strength by ASTM 1424-63; and nitrogen by the Kjeldahl method. Testing for formaldehyde release was performed on unwashed specimens; all other testing was done on washed fabrics. In the tables, breaking strengths and tearing strengths of the finished fabric are expressed as percentage of the original value of the untreated fabric.

EXAMPLE 1

Aqueous solutions were prepared to contain (by weight) 9% dimethylol dihydroxyethyleneurea (hereinafter referred to as DMDHEU) and 0.33–1.5% aminomethanesulfonic acid (hereinafter referred to as AMSA). A 3.2 oz/sq yd cotton printcloth fabric was used for treatments. Samples of the fabric were impregnated with these solutions and squeezed through pad rolls to achieve approximately 90% (by weight) wet pick-up of the treatment solution. The wet, impregnated samples were pinned on frames, then dried for 7 minutes at 65° C. and cured for 3 minutes at 160° C. Samples were washed and tested. This example illustrates that the zwitterion AMSA can serve as an efficient catalyst for durable-press finishing. Results are given in Table I.

TABLE I

| AMSA % | DP RATING | BREAKING STRENGTH % | TEARING STRENGTH % | NITROGEN % |
|---|---|---|---|---|
| 0.33 | 2.3 | 79 | 79 | 0.94 |
| 0.66 | 3.6 | 67 | 68 | 1.29 |
| 1.00 | 4.1 | 66 | 66 | 1.40 |
| 1.50 | 4.3 | 64 | 59 | 1.36 |

EXAMPLE 2

Finishing baths contained 9% DMDHEU and catalyst concentrations as tested in Table II. Cotton printcloth was treated under the same drying and curing conditions as specified in Example 1. This example describes the treatments in which catalysis is provided by a combination of zwitterion and magnesium salt as well as the control experiments with AMSA and magnesium chloride alone as catalyst. Results are given in Table II.

TABLE II

| CATALYST AMSA % | CATALYST $MgCl_2.6H_2O$ % | DP RATING | BREAKING STRENGTH % | TEARING STRENGTH % | FORMALDEHYDE RELEASE PPM. |
|---|---|---|---|---|---|
| 1.0 | — | 4.2 | 62 | 62 | 1947 |
| 0.75 | 0.63 | 4.7 | 56 | 63 | 1246 |
| 0.50 | 1.25 | 4.8 | 52 | 57 | 1006 |
| 0.25 | 1.88 | 4.7 | 50 | 50 | 918 |
| — | 2.5 | 4.3 | 55 | 55 | 1635 |

EXAMPLE 3

Cotton printcloth was impregnated with solutions containing 9% DMDHEU and the indicated concentrations of AMSA and magnesium chloride, dried at 65° C. for 7 minutes and cured at 160° C. for 3 minutes or 200° C. for 20 seconds. This example illustrates the use of a constant ratio (by weight) of AMSA to $MgCl_2$ but with various levels of the catalyst. It also demonstrates use of the zwitterion catalyst in flash cure treatment as well as at more conventional treatment curing temperatures. Results are given in Table III.

TABLE III

| CURE TEMP °C. | CATALYST AMSA % | CATALYST $MgCl_2.6H_2O$ % | DP RATING | BREAKING STRENGTH % | TEARING STRENGTH % | FORMALDEHYDE RELEASE PPM |
|---|---|---|---|---|---|---|
| 160 | 0.2 | 0.5 | 3.4 | 66 | 68 | 2193 |
| 160 | 0.3 | 0.75 | 4.4 | 59 | 65 | 1354 |
| 160 | 0.4 | 1.00 | 4.6 | 59 | 64 | 967 |
| 160 | 0.5 | 1.25 | 4.8 | 52 | 57 | 1006 |
| 200 | 0.2 | 0.5 | 3.6 | 74 | 64 | 2164 |
| 200 | 0.3 | 0.75 | 4.0 | 65 | 58 | 1459 |
| 200 | 0.4 | 1.00 | 4.7 | 59 | 53 | 1090 |
| 200 | 0.5 | 1.25 | 4.6 | 62 | 55 | 1001 |

EXAMPLE 4

Cotton printcloth was impregnated with solutions containing 9% DMDHEU and the indicated concentration of AMSA and magnesium chloride, dried at 65° C. for 7 minutes and cured at the listed temperatures for 3 minutes. This example illustrates the utility of different curing temperatures in the finishing reaction. Results are given in Table IV.

TABLE IV

| CURE TEMP °C. | AMSA % | $MgCl_2.6H_2O$ % | DP RATING | BREAKING STRENGTH % | TEARING STRENGTH % | FORMALDEHYDE RELEASE PPM |
|---|---|---|---|---|---|---|
| 120 | 0.5 | 1.25 | 2.8 | 83 | 77 | 1859 |
| 130 | 0.5 | 1.25 | 3.9 | 78 | 70 | 1726 |
| 140 | 0.5 | 1.25 | 4.4 | 65 | 63 | 1569 |
| 120 | 1.0 | — | 3.0 | 86 | 81 | 1659 |
| 130 | 1.0 | — | 3.5 | 75 | 73 | 1758 |
| 140 | 1.0 | — | 4.2 | 77 | 69 | 1839 |

EXAMPLE 5

Cotton printcloth was impregnated with solutions containing 9% DMDHEU, 0.5% AMSA, and 1.25% $MgCl_2.6H_2O$, dried at 65° C. for 7 minutes and cured at 160° C. for the listed times. This example indicates the latitude of times operative with this catalyst system. Results are given in Table V.

TABLE V

| CURE TIME (at 160° C.) MINUTES | DP RATING | BREAKING STRENGTH % | TEARING STRENGTH % | WRA (COND) DEG. | FORMALDEHYDE RELEASE PPM |
|---|---|---|---|---|---|
| 1.0 | 4.6 | 63 | 53 | 280 | 1059 |
| 1.5 | 4.5 | 61 | 53 | 280 | 1042 |

TABLE V-continued

| CURE TIME (at 160° C.) MINUTES | DP RATING | BREAKING STRENGTH % | TEARING STRENGTH % | WRA (COND) DEG. | FORMALDEHYDE RELEASE PPM |
|---|---|---|---|---|---|
| 2.0 | 4.7 | 60 | 52 | 280 | 1012 |
| 2.5 | 4.5 | 59 | 53 | 280 | 979 |

EXAMPLE 6

Cotton printcloth was impregnated with solutions containing 0.5% AMSA and 1.25% $MgCl_2.6H_2O$ or 1% AMSA and the listed agents and their concentrations. Fabrics were dried at 65° C. for 7 minutes and cured at 160° C. for 3 minutes or at 200° C. for 20 seconds. This example illustrates the use of the zwitterion catalysts with aldehyde and methylol-amide finishing agents. Results are shown in Table VI.

TABLE VI

| FINISHING AGENT AND CONCENTRATION | DP RATING OF FINISHED FABRIC: AMSA 160° CURE | AMSA 200° CURE | AMSA $MgCl_2.6H_2O$ 160° CURE | AMSA $MgCl_2.6H_2O$ 200° CURE |
|---|---|---|---|---|
| 10% FORMALDEHYDE | 3.3 | 2.6 | 4.4 | 4.3 |
| 10% GLYOXAL | 1.3 | 2.1 | 3.1 | 3.3 |
| 8% DIMETHYLOL-ETHYLENEUREA | 3.5 | 3.7 | 4.3 | 4.4 |
| 10% DIMETHYLOL METHOXYETHYL CARBAMATE | 2.7 | 2.7 | 3.7 | 3.6 |

EXAMPLE 7

Cotton printcloth was impregnated with solutions containing 9% DMDHEU and another zwitterion, 2-aminoethanesulfonic acid (taurine) alone or in combination with $MgCl_2.6H_2O$ at the concentrations listed in the following table. The fabrics were dried at 65° C. for 7 minutes and cured at either 160° C. for 3 minutes or 200° C. for 20 seconds. This example illustrates that a zwitterion with a different chain length may be employed in the durable-press finishing of fabrics by the process of this invention. The results are shown in Table VII.

TABLE VII

| CATALYST: 2-aminoethane-sulfonic acid, % | CATALYST: $MgCl_2.6H_2O$, % | CURING COND.: TIME MIN. | CURING COND.: TEMP °C. | FABRIC PROPERTIES: DP RATING | FABRIC PROPERTIES: BREAKING STRENGTH % | FABRIC PROPERTIES: FORMALDEHYDE RELEASE PPM |
|---|---|---|---|---|---|---|
| 1 | — | 3 | 160 | 2.7 | 77 | 1033 |
| 1 | — | .33 | 200 | 3.0 | 75 | 965 |
| 0.5 | 1.25 | 3 | 160 | 4.2 | 60 | 980 |
| 0.5 | 1.25 | .33 | 200 | 4.4 | 60 | 1019 |

EXAMPLE 8

Cotton/polyester (50/50) sheeting was impregnated with solutions containing 9% DMDHEU and 1% AMSA or 0.5% AMSA and 1.25% $MgCL_2.6H_2O$, dried at 65° C. for 7 minutes and cure at 160° C. for 3 minutes or 200° C. for 20 seconds. This example illustrates the finishing of cotton/polyester fabrics by the process of this invention. The results are shown in Table VIII.

TABLE VIII

| CATALYST: AMSA % | CATALYST: $MgCl_2.6H_2O$ % | CURE: TEMP °C. | CURE: TIME MIN. | FABRIC PROPERTIES: DP RATING | FABRIC PROPERTIES: NITROGEN % | FABRIC PROPERTIES: FORMALDEHYDE RELEASE PPM |
|---|---|---|---|---|---|---|
| 1.0 | — | 160 | 3 | 4.1 | 0.94 | 1345 |
| 1.0 | — | 200 | 0.33 | 4.0 | 0.90 | 1274 |
| 0.5 | 1.25 | 160 | 3 | 4.3 | 1.01 | 725 |
| 0.5 | 1.25 | 200 | 0.33 | 4.2 | 0.97 | 657 |

We claim:

1. A process for the finishing of cellulosic fabrics to produce easy-care textiles, said process comprising:
   (a) treating the fabric by impregnating with a solution containing a cellulose-crosslinking agent, and a zwitterion,
   (b) drying the fabric, and
   (c) curing the fabric.

2. The process of claim 1 including the addition of a magnesium salt in step (a).

3. The process of claim 2 wherein the cellulose-crosslinking agent is selected from the group consisting of aldehydes and methylol amides.

4. The process of claim 2 wherein the cellulose-crosslinking agent is selected from the group consisting of formaldehyde, glyoxal, dimethylol dihydroxyethyleneurea, dimethylol ethyleneurea, and dimethylol methoxyethyl carbamate.

5. The process of claim 2 wherein the zwitterion is selected from the group consisting of aminoalkanesulfonic acids, aminoalkanesulfinic acids, aminoalkanephosphonic acids, aminoalkanephosphinic acids, and amino acids containing fewer amino than carboxyl groups.

6. The process of claim 2 wherein the zwitterion is selected from the group consisting of aminomethanesulfonic acid and 2-aminoethanesulfonic acid.

7. The process of claim 2 wherein the magnesium salt is magnesium chloride.

8. The process of claim 2 wherein the curing step is conducted at a temperature of from about 120° C. to about 200° C. for from about 20 seconds to about 3 minutes, time and temperature being inversely adjusted.

9. In a process for imparting easy-care properties to cellulosic textiles, said process, of the type wherein the textile is impregnated with an aqueous formulation containing a formaldehyde-amide cellulose-crosslinking agent and magnesium chloride, the improvement comprising: Adding aminomethanesulfonic acid to the formulation to provide a more efficient catalyst system that promotes the finishing reaction and yields a treated fabric with an unusual combination of smooth-drying appearance, wrinkle resistance, serviceable strength, and inoffensive formaldehyde release properties.

* * * * *